United States Patent [19]

Danks

[11] 4,442,615

[45] Apr. 17, 1984

[54] SPORTS FOOTWEAR

[76] Inventor: Jack Danks, 73 Knowles Rd., Rowley Regis, Warley, West Midlands B 65 8HE, England

[21] Appl. No.: 307,998

[22] Filed: Oct. 2, 1981

[30] Foreign Application Priority Data

Oct. 6, 1980 [GB] United Kingdom ..... 8032187

[51] Int. Cl.[3] ..... A43B 5/00

[52] U.S. Cl. ..... 36/133

[58] Field of Search ..... 36/133, 128, 132, 45

[56] References Cited

U.S. PATENT DOCUMENTS 4,204,346 5/1980 Fugere ..... 36/114

FOREIGN PATENT DOCUMENTS 2801984 7/1979 Fed. Rep. of Germany ..... 36/133

2827172 1/1980 Fed. Rep. of Germany ..... 36/133

*Primary Examiner*—Patrick D. Lawson

*Attorney, Agent, or Firm*—Seidel, Gonda & Goldhammer

[57] ABSTRACT

A sports boot or shoe, such as a soccer boot, has a stippled material secured to at least a portion of the outer surface of the upper of the boot or shoe, with the stippled surface of the material facing inwardly thereof. Preferably, the stippled surface of the material is bonded to a flexible substrate, such as, a foamed plastics material. The outwardly facing surface of the material can be substantially smooth or be provided with outwardly facing stipples. The stippled material, and optionally in combination with its flexible substrate, provides a friction pad which reduces the spin of a ball impacting therewith, as well as acting as a shock absorber to reduce the impact energy of a ball contacting the pad.

12 Claims, 3 Drawing Figures

SPORTS FOOTWEAR

DESCRIPTION

This invention relates to sports footwear, such as, boot or shoes, and is especially, but not exclusively, related to boots for playing Association Football (Soccer).

Numerous proposals have been put forward for improving the frictional or grip characteristics of sports boots or shoes used for kicking game balls, one having been a stippled material secured to selected areas of the uppers of the boots or shoes, with the stipple facing outwardly thereof.

In accordance with the invention, however, there is proposed the use of a stippled material which is secured to the uppers of the boots or shoes in such a way that it provides them with improved frictional or grip characteristics in contact with a ball.

Accordingly, the invention provides a sports boot or shoe having a stippled material secured to at least a portion of the outer surface of the upper of the boot or shoe, with the stippled surface of the material facing inwardly thereof.

Thus, the un-stippled or smooth surface of the material faces outwardly with respect to the boot or shoe, although in one embodiment of the invention, this otherwise smooth outer surface of the material can also be stippled, whereby this further stippled surface faces outwardly of the boot or shoe.

The inwardly facing stipples, whether the outer surface of the material is stippled or not, are preferably bonded to a flexible substrate, such as, a layer of foam material.

Two preferred embodiments in accordance with the invention will now be described by way of example and with reference to the accompanying drawing in which.

Figure 1:
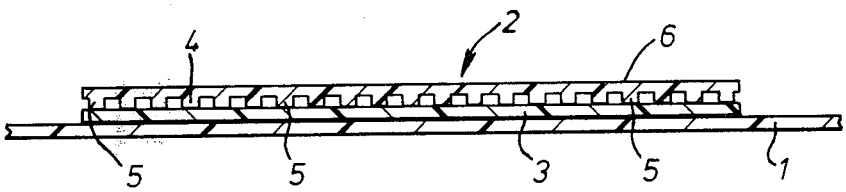
FIG. 1 is a cross-sectional view of a portion of a first embodiment of soccer boot.
Figure 2:
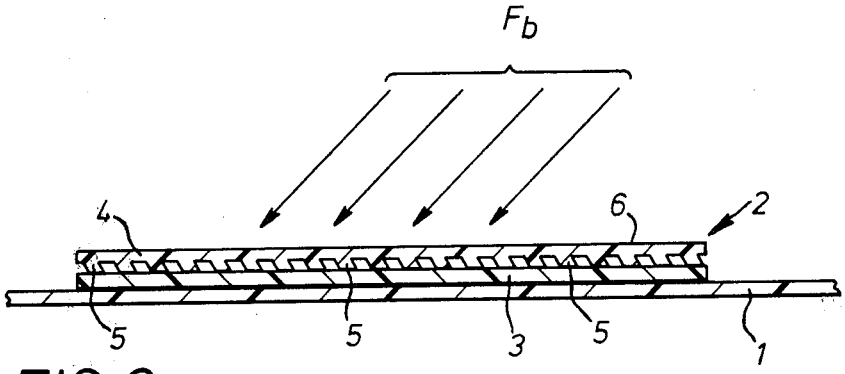
FIG. 2 is a cross-sectional view of the embodiment of soccer boot, as shown in FIG. 1, in use.

Referring firstly to FIGS. 1 and 2 of the drawing, a first embodiment of soccer boot comprises an upper 1, of which a portion only is shown and which is made of a suitable material, such as, leather, and a friction pad 2 consisting of a flexible foamed plastics layer 3, whose inner surface is secured to the outer surface of the upper 1, and a layer of flexible, rubber-like, stippled material 4 whose stipples 5 are bonded to the outer surface of the foam layer 3. Thus, the stippled surface 5 of the layer 4 faces inwardly of the boot, whilst its smooth outer surface 6 faces outwardly of the boot.

Figure 3:
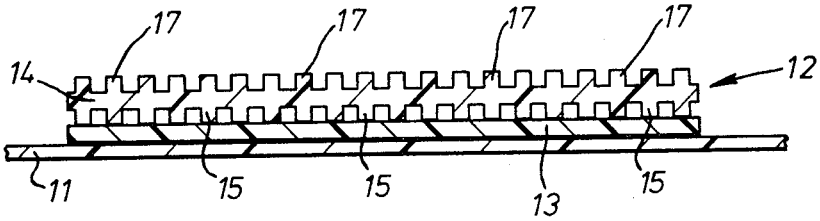
FIG. 3 is a cross-sectional view of a portion of a second embodiment of soccer boot.

Referring now to FIG. 3, a second form of soccer boot comprises an upper 11, also made of a suitable material, such as, leather, and a friction pad 12 consisting of a foamed plastics layer 13 whose inner surface is secured to the outer surface of the upper 11, as in the case of the boot described above with reference to FIGS. 1 and 2. The friction pad 12 also comprises a flexible stippled layer 14 which is of a rubber-type material and is stippled on both its inner and outer surfaces, with the inner stipples 15 bonded to the outer surface of the foam layer 13 and the outer stipples 17 facing outwardly of the boot. Thus, in this embodiment of soccer boot, the friction pad 12 has two flexible stippled surfaces 15, 17 of which one 15 faces inwardly of the boot and the other 17 outwardly thereof.

The friction pads shown in the Figures may be secured to any suitable area of the upper 1, 11 of the boot, for instance, on both sides thereof. Also, the friction pad 2, 12 may be stitched or adhered to the outer surface of the upper 1, 11 or, alternatively, may be incorporated in any other suitable manner in the boot. Otherwise, the friction pads 2, 12 can be detachably secured to the uppers 1, 11, so that they can be adjusted to any preferred location upon the boot.

It has been found that the friction pads 2, 12 are such that when they contact a ball, the inwardly facing (reverse), flexible stipples act as a type of "shock absorber", so that the full impact of the ball with the outer surface of the layer 4 is reduced, thereby providing better control of the ball, as shown in FIG. 2, wherein the force of the ball impacting with the friction pad is referenced by the arrows $F_b$. Thus, on such impact, the stipples 5 bend to absorb some of the energy of the ball. A similar absorption of the energy of the impacting ball is provided by the friction pad 12 shown in FIG. 3. However, additional energy absorption and reduction in ball spin is achieved by the outwardly facing stipples 17. In addition, it has been found that the soccer boots in accordance with the invention give more spin to a ball when kicked, thereby creating more swerve or "bend" to the flight of the ball.

The inwardly facing (reverse) stipples of the friction pad 2, 12 also enable a soccer player wearing the boots of the invention to control a spinning ball, apart from cushioning the impact of the ball with the boot.

The inwardly facing (reverse) stipples 5, 15 can be made in various thicknesses and lengths, whereby, the longer the stipple, the greater the reduction in the spin of the ball when it makes contact with the friction pad. Furthermore, it has been found that shorter and thicker stipples are preferred when kicking a ball. Thus, depending upon a soccer player's position on the field of play, the stipples can be varied in length. For instance, an attacking player could have boots with shorter and thicker stipples on the friction pad for shooting at goal, whereas a defensive player could have longer thinner stipples for trapping and controlling oncoming balls.

It will be appreciated that, in order to maintain the flexibility of the boot's upper, the friction pads are preferably made wholly of flexible materials.

Also it is to be understood that in other forms of friction pad, the foamed plastics layer 3, 13 may be eliminated, in which case the friction pad 2, 12 comprises solely the stippled layer 2, 12 whose inwardly facing stipples 5, 15 can be bonded directly on to the outer surface of the boot upper 1, 11.

I claim:

1. A sports boot or shoe having a stippled material secured to at least a portion of the outer surface of the upper of the boot or shoe, with the stippled surface of the material facing inwardly thereof.

2. A sports boot or shoe according to claim 1, wherein the other surface of the material, which faces outwardly of the boot or shoe, is substantially smooth.

3. A sports boot or shoe according to claim 1, wherein the other surface of the material, which faces outwardly of the boot or shoe, is stippled.

4. A sports boot or shoe according to claim 1, wherein the inwardly facing stipples of the stippled surface are bonded to a flexible substrate.

5. A sports boot or shoe according to claim 4, wherein the flexible substrate is a foamed plastics material.

6. A sports boot or shoe according to claim 4, wherein the flexible substrate is detachably secured to the upper of the boot or shoe.

7. A sports boot or shoe according to claim 1, wherein the stippled material is detachably secured to the upper of the boot or shoe.

8. A sports boot or shoe according to claim 1, wherein the stippled material is stitched to the upper of the boot or shoe.

9. A sports boot or shoe according to claim 1, wherein the stippled material is secured by adhesive to the upper of the boot or shoe.

10. A sports boot or shoe according to claim 1, wherein the stippled material is secured to both sides of the upper of the boot or shoe.

11. A sports boot or shoe according to claim 1, wherein the stippled material is flexible.

12. A sports boot or shoe according to claim 11, wherein the stippled material is a rubber-like material.

* * * * *